US008028945B2

(12) United States Patent
Gingras

(10) Patent No.: US 8,028,945 B2
(45) Date of Patent: Oct. 4, 2011

(54) REFINER PLATES HAVING STEAM CHANNELS AND METHOD FOR EXTRACTING BACKFLOW STEAM FROM A DISK REFINER

(75) Inventor: Luc Gingras, Lake Oswego, OR (US)

(73) Assignee: Andritz Inc., Glens Falls, NY (US)

( * ) Notice: Subject to any disclaimer, the term of this patent is extended or adjusted under 35 U.S.C. 154(b) by 517 days.

(21) Appl. No.: 12/114,959

(22) Filed: May 5, 2008

(65) Prior Publication Data

US 2008/0296419 A1 Dec. 4, 2008

Related U.S. Application Data

(60) Provisional application No. 60/941,065, filed on May 31, 2007.

(51) Int. Cl.
*B02C 23/02* (2006.01)

(52) U.S. Cl. ..... 241/245; 241/261.3; 241/296

(58) Field of Classification Search ..... 241/296–298, 241/261.2, 261.3, 245–248
See application file for complete search history.

(56) References Cited

U.S. PATENT DOCUMENTS 4,676,440 A * 6/1987 Perkola ..... 241/261.3
5,863,000 A * 1/1999 Gingras ..... 241/28
2006/0006265 A1 1/2006 Sabourin et al.

* cited by examiner

*Primary Examiner* — Bena Miller
(74) *Attorney, Agent, or Firm* — Nixon & Vanderhye P.C.

(57) ABSTRACT

A refining plate for refining lignocellulosic material including: a radially outer peripheral edge and a substrate surface; a refining zone having a plurality of substantially radially disposed bars and grooves between the bars, wherein the bars protrude upward from the substrate surface and the grooves each have a groove width, and a steam channel traversing the bars and grooves of the refining zone, wherein the steam channel has a radially outer end radially inward of the outer peripheral edge of the plate and the steam channel has a width substantially greater than the groove width.

23 Claims, 6 Drawing Sheets

REFINER PLATES HAVING STEAM CHANNELS AND METHOD FOR EXTRACTING BACKFLOW STEAM FROM A DISK REFINER

RELATED APPLICATION

This application claims the benefit of U.S. Patent Application Ser. No. 60/941,065 filed May 31, 2007, which is incorporated by reference in its entirety.

BACKGROUND OF THE INVENTION

This invention relates to a disk refiner for ligno-cellulosic materials, and generally to disk refiners used for producing fiberboard and mechanical pulps for medium density fiberboard (MDF), thermomechanical pulps (TMP) and a variety of chemi-thermomechanical pulps (CTMP), which are collectively referred to as mechanical pulps and mechanical pulping process. In particular, this invention relates to steam flow through disk refiners in mechanical pulping processes.

A disk refiner may be used in a thermo-mechanical pulping (TMP) refiner in which the pulp material, such as wood chips, is ground in an environment of steam between a rotating grinding disk (rotor) and a stationary disk (stator) (or a pair of rotating disk rotors) each with radial grooves that provide the grinding surfaces. The rotor may operate at rotational speeds of 1000 to 2300 revolutions per minute (RPM).

Wood chips are fed to the center of the opposing disks of a disk refiner. The chips are broken down between the disks as centrifugal force pushes the chips towards the disk outer circumference. The refiner plates generally include a pattern of bars and grooves which provide repeated compression actions on the chips. The compression action results in the separation of lingo-cellulosic fibers out of the raw chips. The fiber separation transforms the raw chip material into fiber pulp suitable for a final product, such as fiberboards.

While the chips are retained between the disks, energy is transferred to the chips via the refiner plates attached to the disks. The energy is in the form of high centrifugal and compression forces applied to break-down the wood chips. The refining process also generates high frictional forces that causes water in the chip feed material to convert to high pressure steam.

In most disk refiners, the steam from the disk refiner flows in the same direction, e.g., radially outward from between the disks, as the fiber material exiting the refining disks. By way of example, typically between 60% and 100% of the steam produced between the disks in a refiner flows in a forward direction, which is the same direction as the fiber material moving between the refining disks. These percentages for forward flowing steam vary depending on refiner plate patterns and process conditions. After exiting the outer periphery of the fiber disks, the forward flowing steam carries fiber pulp through blow lines downstream of the disk refiner. The pressure of the forward flowing steam is released as the refined fiber pulp material exits the blow lines and enters bins and other relatively low pressure vessels. In MDF, the forward flowing steam typically adds little value to the pulping process and the pressure energy in the forward flowing steam is generally not used. In mechanical pulping, some systems allow for the recovery of heat energy in the forward flowing steam from a discharge cyclone, and other systems vent the forward flowing steam to atmosphere. When recovered such as via a heat exchanger, the heat from forward flowing steam from the mechanical refining processes is typically used for paper machine dryers and on pulp drying equipment High pressure steam is needed in the feeding side of the refiner in MDF and other mechanical pulping systems. Steam is used to soften the wood to improve the performance of the refiner and produce fiber. High pressure steam for refining is usually provided a combination of back-flowing steam from the refiner and fresh steam, usually generated by a boiler. Fresh steam is expensive to produce in terms of energy consumption. There is a long felt need for sources of high pressure steam for pulping processes.

A source of high pressure steam is the steam generated during mechanical refining. High pressure steam is generated between refining disks in a disk refiner. In a traditional refiner, up to 40% of the high pressure steam generated between does not flow in a forward direction with the chip feed material. To the extent that the high pressure steam between the disks can be extracted without loss of pressure, the high pressure steam may be directed to a steaming vessel in a chip feed system of a mechanical refining plant.

A known technique to capture high pressure steam from the disks is to allow the steam to back flow against the movement of chip material between the refining disks and through the feeding system to the chip pre-steaming vessel. High pressure back flow steam has been used in the pre-steaming vessels. Separate piping has been added to refiners to allow back flow steam to bypass the conveyors and feeding devices from the feeding system, and allow the back flow steam to move with little resistance from the refiner inlet to the pre-steaming vessels.

The amount of back flow steam is generally reduced by the use of directional (low energy) refiner plates. Low energy plates typically reduce steam generation by 10 to 50% in a refiner and reduce the amount of back flow steam by 20 to 70%, as compared to conventional higher energy refiner plates. While directional MDF refiner plates are advantageous in reducing the energy required to drive a disk refiner, the reduction in the available back flow steam increases the amount of high pressure steam needed for a mechanical refining plant.

There is a long felt need for techniques to reduce the amount of high pressure steam needed to be produced at high energy costs for a mechanical refining plant. In particular, there is a long felt need to capture a greater amount of high pressure steam from the refining process than is presently captured using directional (low-energy) refiner plates in mechanical refining plants.

BRIEF DESCRIPTION OF THE INVENTION

A novel refiner plate has been developed to increase the amount of high pressure steam extracted from refiner plates, and especially low energy refiner plates. The refiner plate includes steam channels that cut through the refining section and provide a passage for back flow steam. Advantages of the refiner plate include increased amount of high pressure steam available for other purposes in the refining plant, and low-energy refining associated with directional plates.

A refining plate has been developed for refining lignocellulosic material, where the plate includes: a radially outer peripheral edge and a substrate surface; a refining zone including a plurality of substantially radially disposed bars and grooves between the bars, wherein the bars protrude upward from the substrate surface and the grooves each have a groove width, and a steam channel traversing the bars and grooves of the refining zone, wherein the steam channel has a radially outer end radially inward of the outer peripheral edge of the plate and a width substantially greater than the groove width.

The refining plate may include a dam extending across the steam channel at a radially outward inlet end of the channel. The plate, such as a rotor or stator plate, may include an inlet zone adjacent a radially inner end of the steam channel. The gap between bars in the inlet zone should be at least as wide as the steam channel. The refining plate comprise an annular array of plate segments where each segment includes the refining zone, and a plurality of the plate segments (but not necessarily all segments) includes at least one steam channel.

A method has been developed to extract high pressure steam from a refining system comprising: introducing a cellulose fibrous feed material to an inlet of a disk refiner; feeding the cellulose fibrous feed material between opposing disks of the refiner, wherein one disk rotates relative to the other; refining the cellulose fibrous feed material between opposing refiner plates each mounted on a respective one of the opposing plates, wherein each refiner plate has a zone of refining bars and grooves; back flowing steam generated during the refining of the feed material flows through channels in the zone of at least one of the plates, wherein the channels have a width substantially greater than a width of the grooves, and extracting the back flow steam from the disk refiner from an outlet radially inward of an outlet of the channels.

The pressure of the back flow steam may be extracted at a pressure of 1 to 8 bar (gauge pressure). The back flow steam is forced to flow radially inward through the channels (and possibly a discontinuous steam channel) by forming a radially outer end of the channel substantially radially inward of the outer circumference of the disks. The back flow steam may be discharged from the channel to a coarse zone of the refining plate, wherein the coarse zone is radially inward of the channel and spacing between the bars in the coarse zone is at least as wide as that of a steam flow channel.

BRIEF DESCRIPTION OF THE DRAWINGS

The following identified figures included with this application illustrate preferred embodiments and the best mode of the invention.

DETAILED DESCRIPTION OF THE INVENTION

A steam channel has been developed for use in refiner plates, such as rotor and stator plates in mechanical pulping refining. The steam channel allows high pressure steam generated during mechanical refining of cellousic material, e.g., wood chips, to back flow through a refining zone(s) in the plates and be extracted as high pressure steam.

The refiner plate segments disclosed herein are primarily applicable to MDF and TMP refining and for use in a mechanical refiner, such as a disk refiner for refining wood fibers. The plate segments may be directional and low energy plates. Steam channels are included on the plate segments to increase the volume of high pressure steam that back flows through the refiner in a flow direction opposite to the flow of the chips flow between the plates of the refiner.

Figure 1:
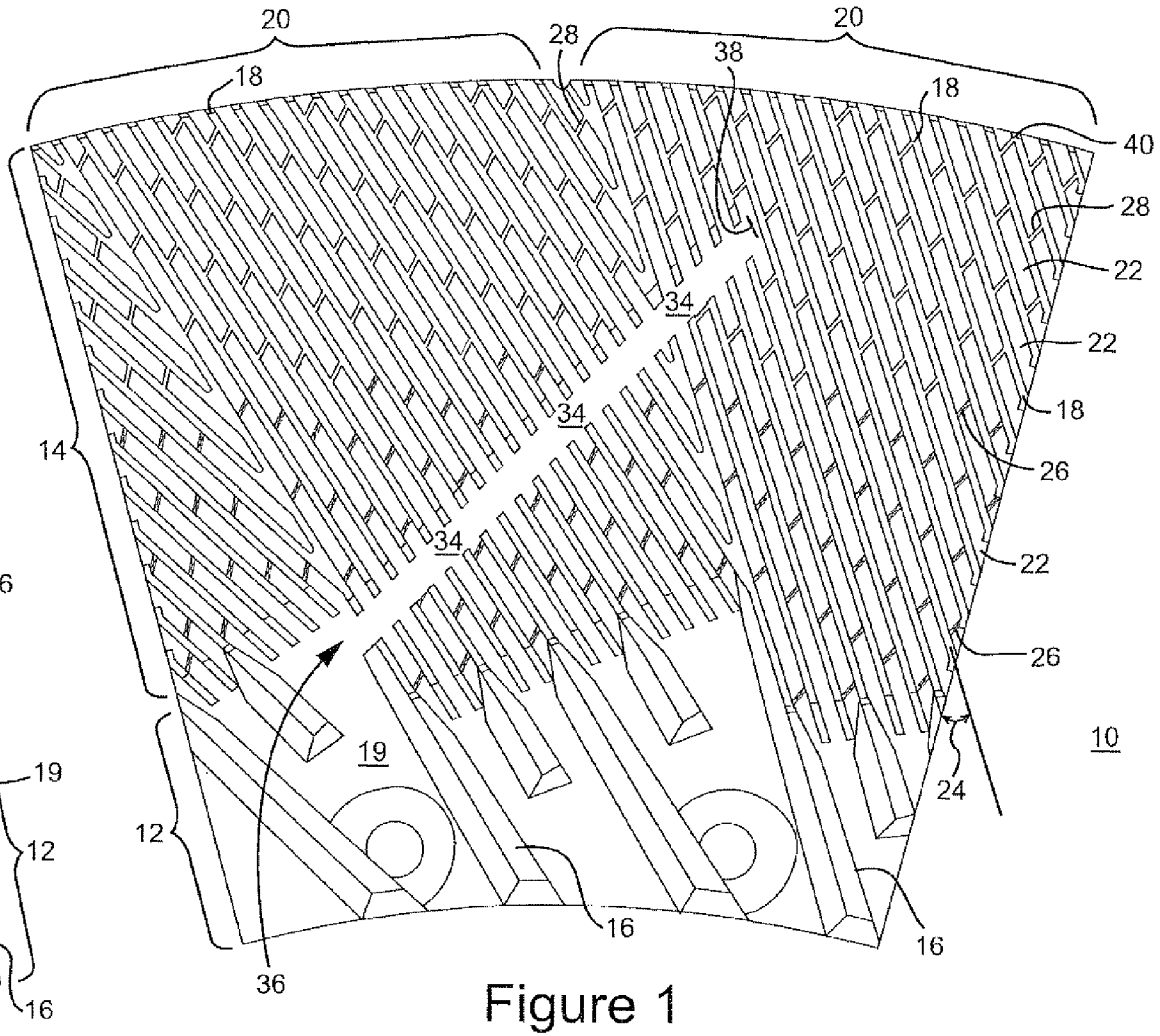
FIG. 1 is a front view of a first directional, low energy refiner plate segment wherein the segment includes a steam channel.
Figure 2:
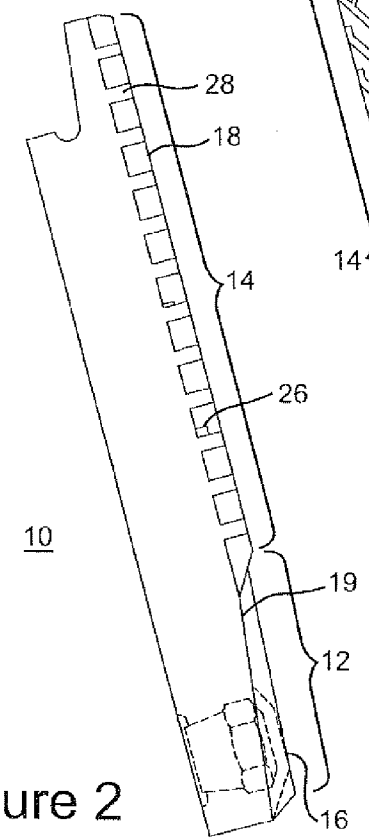
FIG. 2 is a side view of the first plate segment.

FIGS. 1 and 2 show a front view and a side view, respectively, of a stator or rotor plate segment 10 having an inlet section 12 and an outer section 14. An array of plate segments is arranged in an annulus on a refiner disk to form an annular refining plate. The plate is mounted on a disk. In a disk refiner, a rotor plate faces a stationary stator plate with a refining gap between the plates. The plate is formed of plate segments 10 arranged in an annular array on the disk. The plate segments of a stator plate may have similar bar and groove features as an opposing rotor plates, or the stator and rotor plates may have different bar and groove features. The rotational direction for the rotor plate is typically counter-clockwise. The stator plate is typically stationary. A refining gap is defined between the opposing stator and rotor plates.

The inlet section 12 is the feeding part of the plate. The inlet section 12 feeds the incoming fibrous material to the outer refining section 14, preferably with minimal frictional energy and minimal work of the feed material. The inlet section may include coarse bars 16 that feed the chip material to the outer section. Between the coarse bars are wide gaps that allow for the passage of back flow steam.

The outer refining section 14 of the refiner plate segment is the area where the energy is applied to the feed material to break down the wood chips into a fibrous pulp. By way of example, the outer section should preferably be a radial distance of between 100 millimeters (mm) to 200 mm (4 to 5 inches).

By way of example, the outer refining section 14 may be comprised of straight bars 18 and narrow grooves 22. A bar 18 is an extended ridge protruding from the substrate surface 19 of the plate segment. The height of the bar is typically at least as great as the width of the bar. The length of each bar is typically substantially greater than its width. The bars extend along their length in a direction predominately radial with respect to the plate segment, but the direction of the bar often also includes a tangential component, especially for directional, low energy refiner plates. The bars 18 may be straight, curved or irregular.

The bars may be grouped side-by-side in zones 20 of, for example, twenty (20) of parallel bars 18. The bars are arranged so that they are relatively close to each other. The gap between adjacent bars defines a groove 22. Each zone 20 of bars 18 typically includes an equal number of grooves 22 or one less groove than the number of bars. The refining zones 20 may span adjacent plate segments.

The grooves 22 each are defined by opposite sidewalls of adjacent bars 18. The depth of the grooves extend from the upper region of the bars to the substrate surface of the plate. Typically, MDF plates have 3-5 mm bar widths, 5-12 mm groove widths, and 7-12 mm groove depths. TMP plates typically have 1.0-5.0 mm bar widths, 1.5-5.0 mm groove widths, and 1.8-8.0 mm groove depth (a really wide range.

Refining of the fibrous material generally occurs at the upper levels of the bars and grooves of the outer refining section 14. The lower regions of the grooves, i.e., near the substrate 19, typically serve to vent steam and allow chip feed and other materials flow radially outward through the refiner plate.

Pumping directional refiner plates typically have bars arranged such that frictional forces created during the crossing of rotor and stator plates contribute to a net forward force applied to the feed material. The bars are arranged at acute angles with respect to a radius and angle towards the rotational direction of the rotor plate. Directional plates reduce the retention time of the feed material between the plates. The refiner operates with a smaller operating gap between the rotor and stator plates/disks. Reducing the operating gap tends to reduce the amount of energy needed to achieve a given fiber quality.

Directional refiner plates also tend to generate less steam per amount of fiber produced due to the lower energy input. The pumping angles of the bars in directional refiner plates also tend to cause a greater percentage of the steam generated to flow forward (in the same radial direction as the chip material), as compared to bi-directional refiner plates having an average pumping angle of zero. The amount of backward flowing steam in directional refiner plates is significantly reduced as compared to bi-directional plates.

Running directional (or low-energy) refiner plates typically reduces steam generation by 30-50% and 10-20% in TMP, as compared to bi-directional plates. steam generation reduced 10-20% in TMP, 30-50% in MDF, usually. Back-flowing steam reduction with directional refiner plates may be 20 to 90%, as compared to bi-directional plates, with TMP plates have a lesser reduction in back-flow steam and MDF plates having a greater reduction in back-flow steam.

Dams 24, 26 may be included in the grooves to retard the flow of fibrous materials in the lower region of the grooves. Dams 26, 28 are arranged in the grooves to prevent excessive fiber flow through the grooves. Split height dams 26 may be arranged at radially inward regions of the grooves. Full height dams 28 (also referred to as "surface dams") may be at the radially outward regions of the grooves or may be arranged throughout the length of the grooves. MDF and TMP refiner plate segments tend to have many dams arranged in their grooves. The dams increase the refining that occurs between the plates by slowing the flow of fibrous materials between the plates.

The dams between the grooves of refiner plates also substantially reduce the back-flow of steam. Steam may back flow by moving through the grooves generally radially inward and to the inlet to the refiner plates. Back flow steam flows radially inward and in a counter-flow direction to the generally radially outward movement of the chip and fiber material and much of the steam. The back flow steam occurs in the lower regions of the grooves, which regions are near the substrate of the plate. Back flow steam is most likely to occur in grooves that do not have dams. Dams block the flow of back flow steam.

The high pressure of back flow steam may be useful for other applications in a refiner plate. To promote back flow steam, channels 34 are preferably provided in the stator plate segment. The channels 34 provide a flow path to allow steam to back flow radially inward towards the center inlet of the refiner. The channels 34 provide passage for back flow steam through the refining zone. The steam channels facilitate the flow of steam in a counter-flow direction to a relatively large volume flow (as compared to the back flow steam) of fiber material being fed to the center inlet of the plates and moving radially outward to the outer circumferential outlet of the plates.

Steam channels 34 may be arranged in rotor plates. A rotor pumping effect (due to centrifugal force) may reduce the amount of back flow steam in a steam channel in a rotor plate. The pump effect also advantageously reduces the fiber flowing back in the rotor channels 34, as compared to steam channels in a stator plate.

Stator steam channels have a higher efficiency for steam removal, but allow more fiber to flow back as compared to steam channels in a rotor plate. The steam channels 34 arranged in the stator plate segments because the centrifugal forces in the stator plate on steam flow in channels and grooves, is low compared to the centrifugal forces acting on steam flowing in the grooves on the rotating rotor plate.

The steam carrying channels 34 are preferably at least one-half inch wide (1.3 centimeter (cm)) and a length of two inches (5.1 cm) to eight inches (20.3 cm). The steam channel 34 may have a radially inward steam discharge end 36 adjacent, at or near the inlet section 12 of the stator plate segment. The radially inward end 36 of the channel preferably opens to a section in which the bars are spaced apart at least three-quarters of an inch (1.8 cm). The inlet section 12 of bars generally has bars space wide apart and allows for back flow of steam. A section of bars spaced apart at least three-quarters of an inch on a stator plate will allow steam to back flow through its grooves. Steam back flow channels may not be needed in zones of a refiner plate having bars spaced apart by at least three-quarters of an inch.

The radially outer end 38 of the steam channels 34 may not extend to the outer circumferential edge 40 of the plate segment. The outer end 38 of the channel may be one inch (2.54 cm) radially inward of the outer circumferential outer edge 40 of the plate. Alternatively, the outer end of the steam channel may be at approximately one-half the radial distance of the refining zone. The selection of the radial end location of the steam channel depends on the particular refiner and plates, the desired amount back flow steam and the refining process. Ending 38 the channel before the outer circumferential outer plate edge 40 prevents steam and chip material in the channel from flowing radially out the discharge of the plates. A surface dam may be placed at the radially outer end 38 of the steam channel, especially if the end is adjacent the plate edge 40.

The channels 34 preferably span at least the inner radial half of the refining zone 14 and a much as 85% of the radial length of the refining zone 14. Steam in the refining section of the refiner plate may back flow through the channel 34 to the center and/or inlet of the refiner.

The steam channels 34 are preferably at an acute angle with respect to a radial line of the stator plate. The channel angle may be in an opposite direction to the angle of the bars in the zone(s) adjacent the channel 34. The channel angle may be 0 degrees to 60 degrees to a radial line. The angled channel reduces the tendency of chip material being push through the channel 34 in an opposite direction to the back flow steam. The chip material tends to flow over the channel in a direction generally transverse to the channel. The chip material tends not to flow in a direction parallel to the channel. The back flow steam in the stator channel 34 tends to flow in lower regions of the channel near the substrate 19 and flow parallel to the channel. Accordingly, the chip material tends not to flow directly counter to the back flow steam in the channel 34. However, the direction of the channel may be radial or in alignment with the angle of the bar.

The steam channels 34 may be as deep as the grooves between the bars. Alternatively, the channels may be shallower or deeper than the grooves depending on the construction of the refiner plate and the desired flow of back flow steam. In plates with multiple refining zones of bars and grooves, wide channels may separate the zones. The channels may be in a tangential direction if separating refining zones that are radially adjacent each other. The annular channels between refining zones may from a portion of a steam channel 34. The steam channel 34 may be discontinuous (see FIG. 3)

along a radial direction of the plate, provided that there is a back flow steam path between the channel sections. Steam may flow between discontinuous channels by flowing in a direction generally perpendicular to a radius of the plate and between adjacent zones of bars and grooves.

More than one steam channel 34 may be used on each refiner plate segment. A steam channel need not be provided in every refiner plate segment in a plate array of segments. The geometry of the channel 34 may be selected based on a desired flow of back flow steam, the refining process, operating variables, and other features of the plate design. The steam channel(s) may be straight, curved, zig-zagged and discontinuous.

Figure 3:
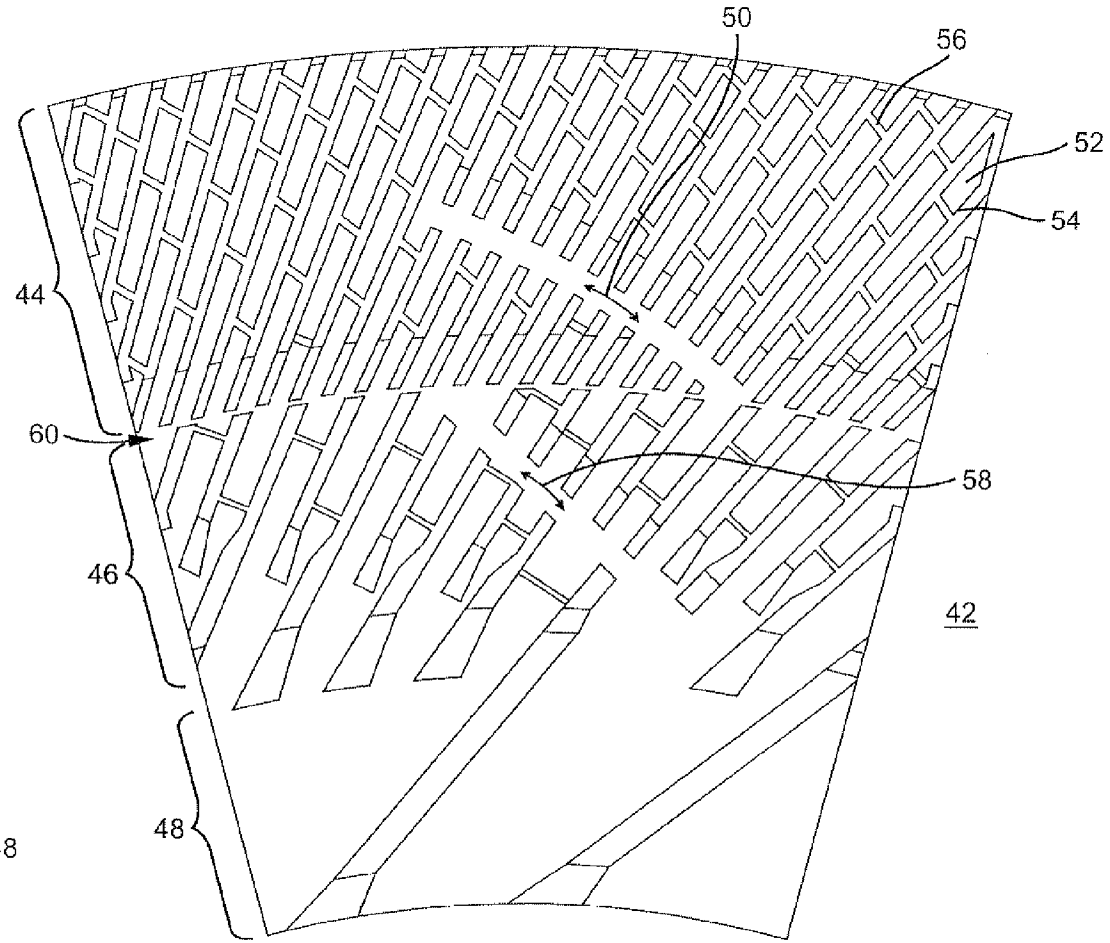
FIG. 3 is a front view of a second directional, low energy refiner plate segment, wherein the segment includes a steam channel.
Figure 4:
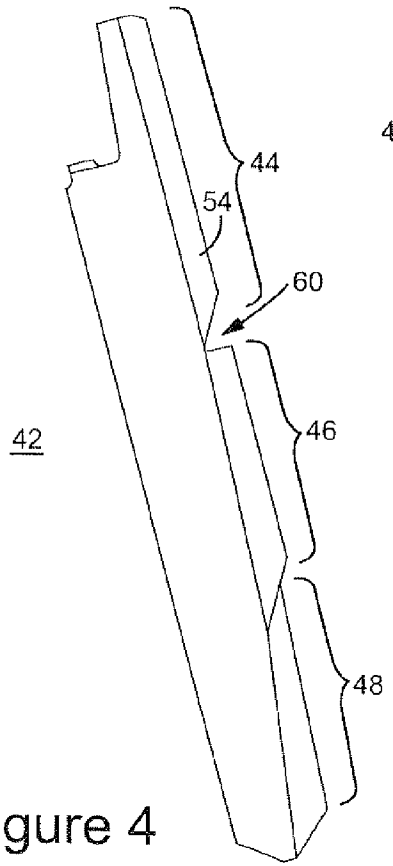
FIG. 4 is a side view of the second plate segment.

FIGS. 3 and 4 are a front view and side view, respectively, of a refiner plate segment 42 having an outer refining section 44, an inner refining section 46, and a coarse bar feeding section 48. A steam channel 50 extends partially through the outer refining section. The channel traverses the relatively narrow grooves 52 between finely spaced bars 54 in the outer refining section 44. Surface dams 56 are in all grooves of the outer section. The radially inward refining section 46 has a steam channel 58 that is discontinuous with the channel 50 in the outer refining section 44. Back flow steam moves from the outer channel 50, through a channel gap 60 between the refining sections 44, 46 and to the inner channel 58. The steam back flowing through inner steam channel 58 discharges to the feeding section 48 that has wide space bars allowing the stem to back flow to a high pressure steam exhaust.

Figure 5:
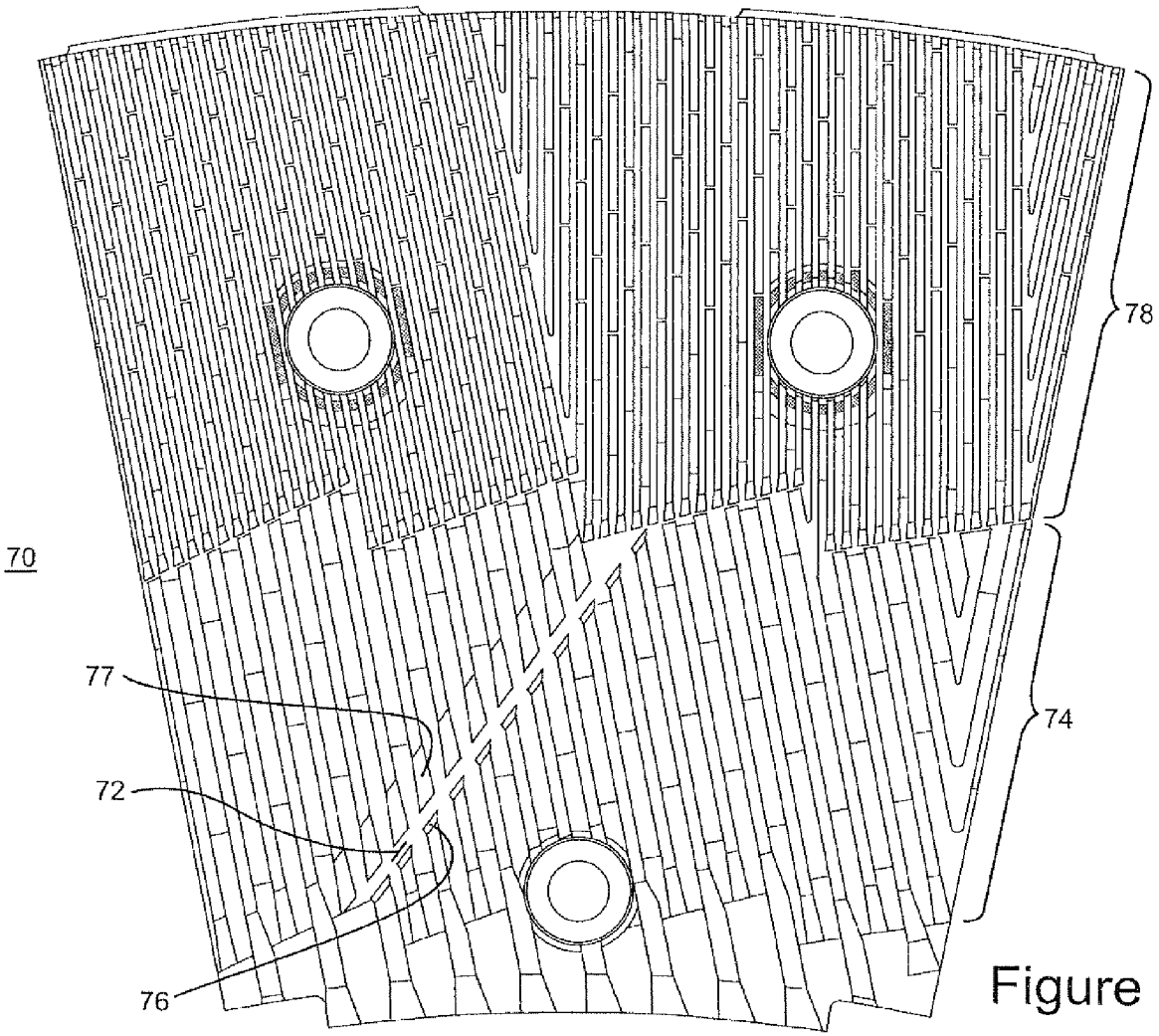
FIG. 5 is a front view of a TMP refiner plate segment wherein the segment includes a steam channel.

FIG. 5 is a front view of a plate segment 70 of a TMP stator plate. A steam channel 72 traverses an inner refiner zone 74. The bars of the inner refiner zone are closely spaced as is typical. There is only a small acute angle between the bars and a radius, which is typical with TMP refining applications. The steam channel 72 is straight and at an angle of approximately 45 degrees with respect to a radius, and at an opposite angle to the angle formed by the bars. The bars on opposite sides of the channel are sloped towards the channel. The bars adjacent the lower side of the channel have a steep slope 76 and the bars adjacent an outer side of the channel have a shallow slope 77. The plate has an outer refining zone 78 without a steam channel. Steam generated in the inner refining zone 74 that flows into the channel may flow radially inward to a steam outlet near an inlet to the plate, which may be near a center of the plate.

Figure 6:
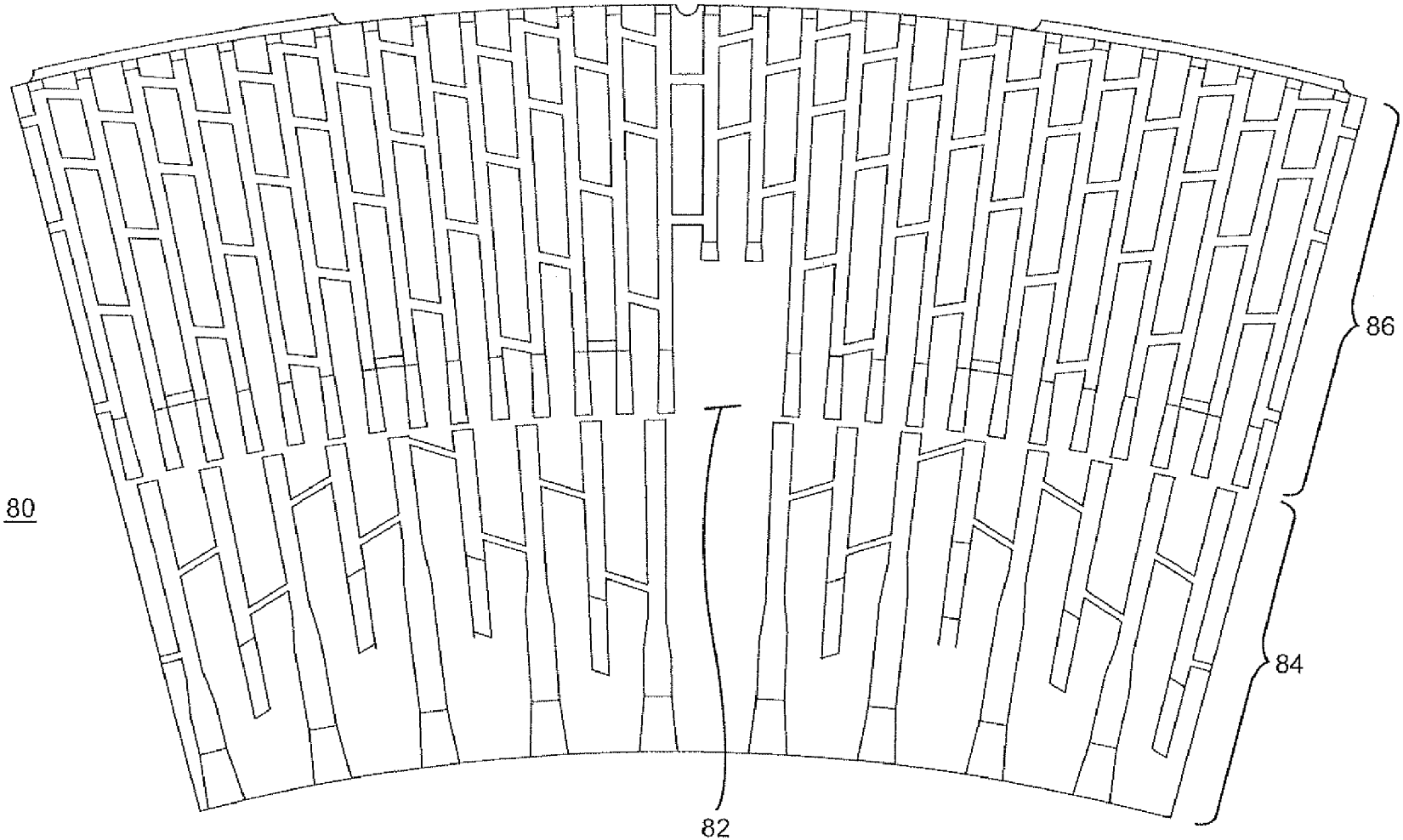
FIG. 6 is a front view of a non-directional refiner plate segment wherein the segment includes a steam channel extending half-way through the refining zone.

FIG. 6 is a front view of a bi-directional plate segment 80 of a MDF stator plate. A wide steam channel 82 extends entirely through an inner refining zone 84 and partially through an outer refining zone 86. The steam channel extends radially and is parallel to radially aligned bars of the inner and outer refining zones 84, 86. The steam channel 82 in the MDF bi-directional plate 80 allows steam generated in the refining zones 84, 86 to flow radially inward to a high pressure steam exhaust port adjacent a radially inward position of the refiner plate.

The radial orientation of the bars allows the stator and corresponding rotor plate to be rotated clock-wise or counter-clock-wise during refining. In contrast to the bi-direction MDF plate shown in FIG. 6, the MDF plates shown in FIGS. 1 and 3 are directional due to the angle formed by their bars with respect to a radial.

Figure 7:
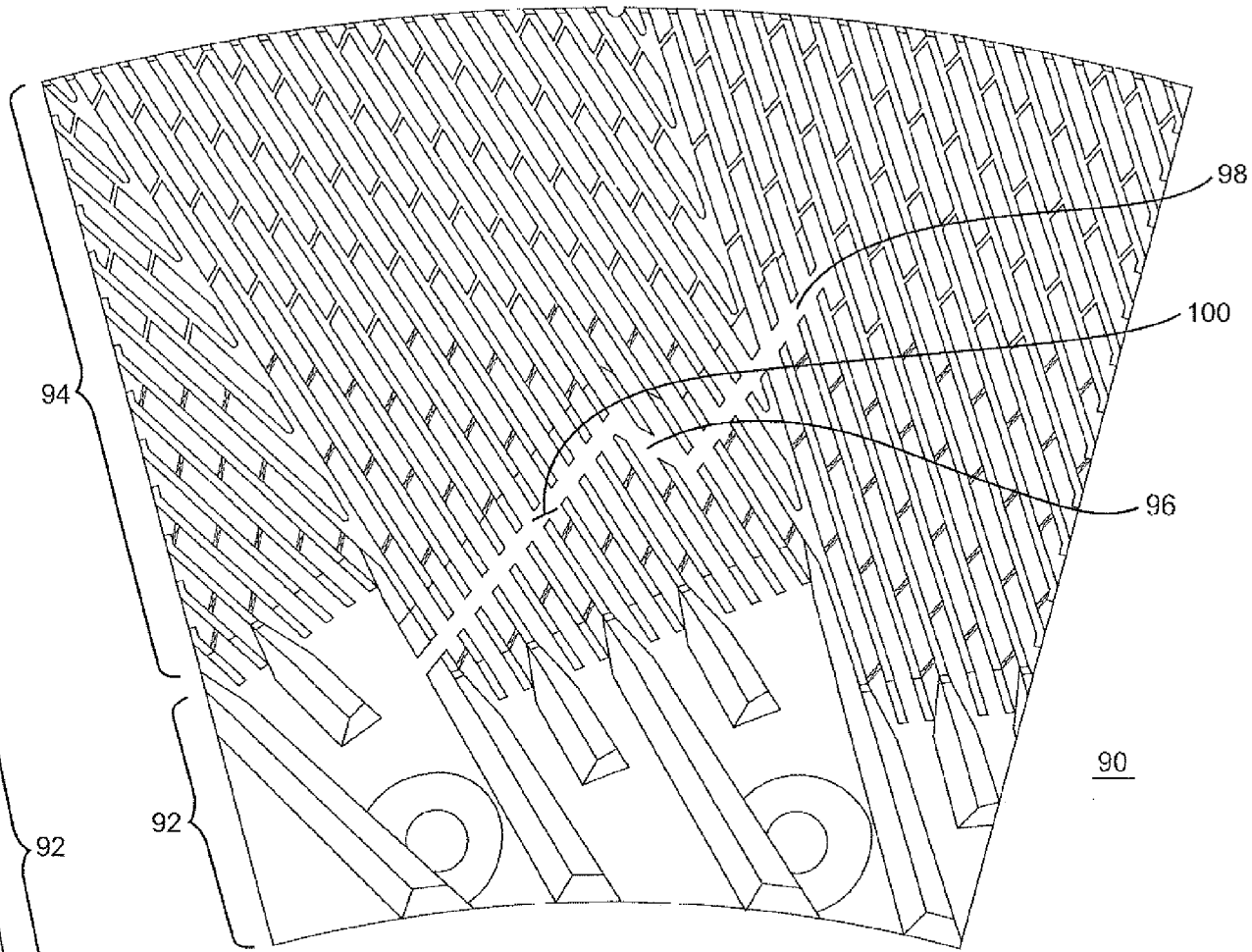
FIGS. 7 and 8 are a front view and a side view, respectively, of a plate segment of a directional, low energy plate.
Figure 8:
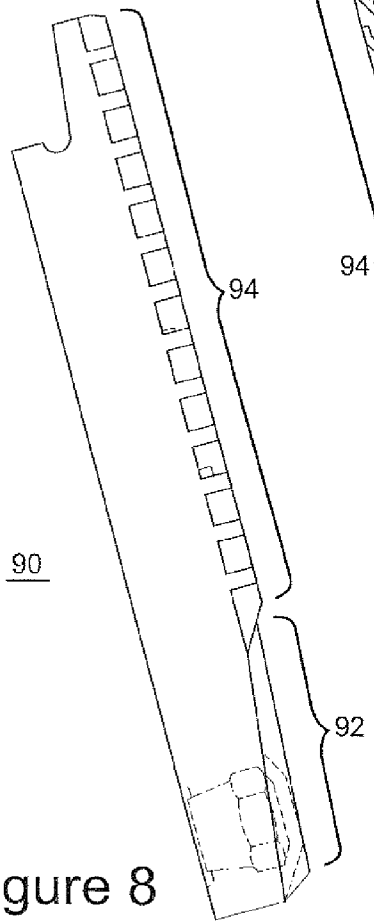

FIGS. 7 and 8 are a front view and a side view, respectively, of a plate segment 90 of a directional, low energy MDF stator plate. An inlet section 92 has wide gaps between the breaker bars that allow steam to flow radially inward. A refining section 94 includes discontinuous steam channels 96, 98 and 100.

The steam channels 96, 98, 100 form a zig-zag pattern traversing approximately two-thirds the radial length of the refining zone. The zig-zag pattern is formed by sections 96, 98 of the steam channel that are generally perpendicular to the bars and a connecting steam channel section 100 generally parallel to bars. The zig-zag pattern tends to direct fiber in the channel to the bars of the refining zone 94 and allows steam to follow the zig-zag pattern. The zig-zag pattern reduces the fibers flowing with the back flowing steam to a high pressure outlet of the refiner.

The zig-zag steam channels 96, 98 and 100 illustrates that a steam channel may traverse the plate along an angle opposite to the angle(s) formed by the bars of the refining section, and along an angle generally aligned with the bars of the plate. An opposite angled steam channel forms an angle with respect to a radial line that is on the opposite side of the radial line from the angle(s) formed by the refining section. An aligned steam channel forms an angle with respect to a radial line that is on the same side of the radial line as the angle(s) formed by the bars of the refining section.

As is evident from FIGS. 1, 3, 5, 6, and 7, a steam channel may be straight or curved, continuous or discontinuous, form an angle opposite to the angles of the refining section or aligned with the refining section, and may be a combination of steam channel segments. Preferably, the steam channel is relatively wide (as compared to the groove widths in the refining section), does not extend to a radially outer edge of the plate or has one or more dams towards the outer edge to prevent steam venting out the outer periphery of the plate, and the channel is relatively deep to allow steam to flow radially inward and below the refining action at the bar tips.

Figure 9:
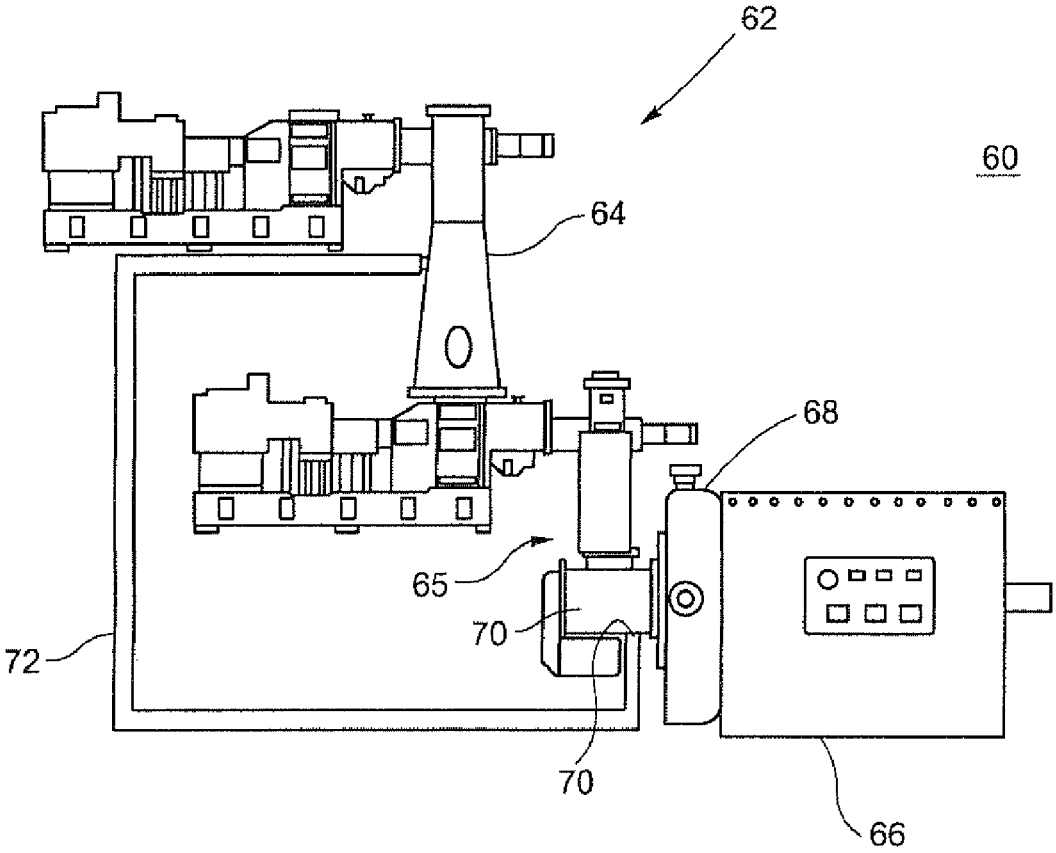
FIG. 9 is a schematic view of refiner system having an outlet for high pressure back flow steam.

FIG. 9 is a schematic side view of a thermomechanical (TMP) refiner system 60, such as is described in US Patent Application Publication 2006/0006265, entitled "High Intensity Refiner Plate with Inner Fiberizing Zone." A chip feed system 62 steams the wood chips and applies a pressure to the slurry of steamed wood chips. A steaming vessel 64 may be used to steam the chips at high pressure, wherein high pressure steam is introduced to the steaming vessel. The chip feed slurry may be at a high pressure, of for example 15 to 25 psig (pounds per square inch gauge).

The high pressure chip feed slurry is fed, via a high pressure chip feed tube 65, to a high consistency primary refiner 66 that has relatively rotating disks. The disks are housed in a casing 68 of the primary refiner 66. A pair of disk oppose each other in the casing such that the array of stator plates face the array of rotor plates and both arrays are coaxial. A narrow gap separates the bars of the stator plate and bars of the rotor plate. The casing is operated at a high pressure, e.g., 1 to 6 bar for TMP, and 6 to 8 bar to MDF. A refiner feed device 71, such as a ribbon feeder, receives the high pressure chip feed slurry and delivers the pressurized slurry to a center inlet of one of the disk such that the slurry is fed between the disks at substantially the inner diameter of the disks.

A back flow steam path is formed by the channels and other steam flow passages on the refiner plates, e.g., the stator and/or rotor plate segments. Other steam flow passages may include inlet sections with widely spaced bars without dams, and annular gaps between inner and outer refining sections. The back flow steam discharges from the steam channels to the inlet sections where the spacing between the bars is relatively wide, e.g., at least one-half of an inch (1.2 cm). The wide grooves between the bars of the inlet section and/or the lack of dams in the inlet section allow back flow steam to flow to a high pressure steam exhaust 70 at the ribbon feeder 71 which is coupled to a center inlet of the disk refiner. Alternatively, piping for back flow steam may receive the steam from a coupling behind the chip chute 65 which is at the top inlet to the ribbon feeder 71. Back flow steam may pass through the ribbon feeder, against the chip flow, and up the chip chute 65 to an inlet to the back flow steam pipe 72.

The high pressure back flow steam exhausted from the disk refiner is available for use as high pressure steam in the preheating portion of the refining process. The back flow steam may be used to reduce the amount of fresh steam added to preheating. The use of high pressure back flow steam is conventional in TMP refining systems. The exhausted high pressure back flow steam may be introduced via steam line 72 to the steaming vessel 64 to steam wood chips prior to the refiner.

The refining plates with channels provide a relatively generous flow of high pressure back pressure steam. This high pressure back flow steam can be used in the refining plant instead of independently generated high pressure steam. The generous flow of high pressure steam provided by the steam channels of the refiner plate segments disclosed herein may reduce the energy requirements in a refiner plant by reducing the volume of high pressure steam to be independently generated.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A refining plate for refining lignocellulosic material, the plate comprising:

a radially outer peripheral edge and a substrate surface;

a refining zone including a plurality of at least partially radially disposed bars and grooves between the bars, wherein the bars protrude upward from the substrate surface and the grooves each have a groove width, and a steam channel traversing the bars and grooves of the refining zone, wherein the steam channel has a radially outer end inward of the outer peripheral edge of the plate and has a width substantially greater than the groove width, and the steam channel is uninterrupted by the bars for at least one half of the radial length or arc width of the refining zone.

2. A refining plate as in claim 1 wherein the bars and grooves are at an acute angle with respect to a radius of the plate.

3. A refining plate as in claim 1 further comprising an inlet zone and the steam channel has a radially inner end adjacent the inlet zone.

4. A refining plate as in claim 1 wherein the plate is a stator plate.

5. A refining plate as in claim 1 wherein the plate comprises an annular array of plate segments and each segment includes the refining zone, and a plurality of the plate segments each includes one of the steam channels.

6. A refining plate as in claim 5 wherein at least one of the plate segments is devoid of the steam channel.

7. A refining plate as in claim 1 wherein the width of the steam channel is at least three-quarters (¾) of an inch.

8. A refining plate as in claim 1 wherein the steam channel discharges to an inlet zone of bars separated by at least one-half of an inch.

9. A refining plate as in claim 1 wherein the plate is adapted to refine fibers for medium density fiberboard (MDF).

10. A refining plate for refining lignocellulosic material, the plate comprising:

a radially outer peripheral edge and a substrate surface;

a refining zone including a plurality of substantially radially disposed bars and grooves between the bars, wherein the bars protrude upward from the substrate surface and the grooves each have a groove width, and a steam channel traversing the refining zone, wherein the steam channel has a radially outer end radially inward of the outer peripheral edge of the plate and the steam channel has a width substantially greater than the groove width, and the steam channel is uninterrupted by the bars for at least one half of the radial length or arc width of the refining zone.

11. A refining plate as in claim 10 wherein the steam channel is parallel to the bars and grooves in the refining zone.

12. A refining plate as in claim 10 the steam channel forms an angle with respect to a radius of the plate opposite to an angle formed by the bars with respect to the radius.

13. A refining plate as in claim 10 wherein the steam channel is straight.

14. A refining plate as in claim 10 wherein the steam channel is at least as deep as the grooves.

15. A refining plate as in claim 14 wherein the steam channel is deeper than the grooves.

16. A refining plate as in claim 10 wherein the steam channel is curved.

17. A refining plate as in claim 10 further comprising an inlet zone and the steam channel has a radially inner end adjacent the inlet zone.

18. A refining plate as in claim 10 wherein the plate is a stator plate.

19. A refining plate as in claim 10 wherein the plate comprises an annular array of plate segments and each segment includes the refining zone, and a plurality of the plate segments includes the steam channel.

20. A refining plate as in claim 19 wherein at least one of the plate segments is devoid of the steam channel.

21. A refining plate as in any of claim 10 wherein the width of the steam channel is at least three-quarters (¾) of an inch.

22. A refining plate as in claim 10 wherein the steam channel discharges into an inlet zone of bars separated by at least one-half of an inch.

23. A refining plate as in any of claim 10 wherein the plate is adapted to refine fibers for medium density fiberboard (MDF).

* * * * *